US010932540B2

(12) United States Patent
Lescht

(10) Patent No.: US 10,932,540 B2
(45) Date of Patent: Mar. 2, 2021

(54) HAIR STYLING DEVICE

(71) Applicant: Melissa Lescht, Ellicott City, MD (US)

(72) Inventor: Melissa Lescht, Ellicott City, MD (US)

( * ) Notice: Subject to any disclaimer, the term of this patent is extended or adjusted under 35 U.S.C. 154(b) by 802 days.

(21) Appl. No.: 15/235,670

(22) Filed: Aug. 12, 2016

(65) Prior Publication Data

US 2018/0042357 A1 Feb. 15, 2018

(51) Int. Cl.

| | |
|---|---|
| ***A45D 20/18*** | (2006.01) |
| ***A45D 20/08*** | (2006.01) |
| ***A45D 2/12*** | (2006.01) |
| ***A45D 2/36*** | (2006.01) |
| ***A45D 2/46*** | (2006.01) |
| ***A45D 2/00*** | (2006.01) |

(52) U.S. Cl.

CPC ..... *A45D 20/18* (2013.01); *A45D 2/001* (2013.01); *A45D 2/125* (2013.01); *A45D 2/127* (2013.01); *A45D 2/367* (2013.01); *A45D 2/46* (2013.01); *A45D 20/08* (2013.01)

(58) Field of Classification Search

CPC .. A46D 20/18; A46D 20/22–46; A45D 20/02; A45D 2/46

See application file for complete search history.

(56) References Cited

U.S. PATENT DOCUMENTS

| | | | | | |
|---|---|---|---|---|---|
| 1,907,215 | A * | 5/1933 | Pfahl | A45D 20/18 | 132/212 |
| 3,006,079 | A * | 10/1961 | Jepson | A45D 20/18 | 285/136.1 |
| 3,281,955 | A * | 11/1966 | Clark, Jr. | A45D 20/18 | 34/99 |
| 3,313,036 | A * | 4/1967 | Fortune | A45D 20/24 | 34/99 |
| 3,608,205 | A * | 9/1971 | Magid | A45D 20/18 | 34/99 |
| 3,822,483 | A * | 7/1974 | Hubner | A45D 20/18 | 34/96 |
| 4,118,874 | A * | 10/1978 | Morane | A45D 20/34 | 34/101 |
| 5,271,160 | A * | 12/1993 | Greiner | A45D 20/22 | 34/283 |
| 2017/0000234 | A1* | 1/2017 | Annunziata | A45D 20/12 | |

* cited by examiner

*Primary Examiner* — Edward Moran

(74) *Attorney, Agent, or Firm* — Foley & Lardner LLP

(57) ABSTRACT

A portable and wearable hair styling device includes a headband configured to conform to a head of a user, a hair wrap attached to the headband, wherein the hair wrap includes a flexible inside layer, an air distribution network, and a flexible outside layer attached to the flexible inside layer creating an interior volume between the flexible inside layer and the flexible outside layer, wherein the flexible outside layer includes a hair dryer attachment and a clip configured to close a lower portion of the hair wrap around hair of the user.

20 Claims, 16 Drawing Sheets

HAIR STYLING DEVICE

BACKGROUND

The present application relates generally to the field of hair styling devices. Hair styling devices typically include devices that must be used manually by a user to style hair. For conventional hair styling devices, a user must hold the devices and manually style their hair, usually occupying both hands of the user. This requires a user to set aside time for straightening, blow drying, and/or curling hair, while forfeiting time that could be spent on other tasks. Further, typical hair styling devices use an electrical cord plugged into an electrical outlet. To use the device, the user must stand near an electrical outlet to power the device while styling their hair. Thus, typical hair styling devices can be inconvenient for a user due to the length of time a user's hands are occupied and restriction of movement while styling.

SUMMARY

One embodiment relates to a hair styling device. The hair styling device includes a headband configured to conform to a head of a user and a hair wrap attached to the headband. The hair wrap includes a flexible inside layer and a flexible outside layer. The flexible inside layer includes an air distribution network. The flexible outside layer is attached to the flexible inside layer creating an interior volume between the flexible inside layer and the flexible outside layer, wherein the flexible outside layer includes a hair dryer attachment and a clip configured to close a lower portion of the hair wrap around hair of the user.

The invention is capable of other embodiments and of being practiced or being carried out in various ways. It is to be understood that the invention is not limited in its application to the details of construction and the arrangements of components set forth in the following description or illustrated in the drawings. Alternative exemplary embodiments relate to other features and combinations of features as may be generally recited in the claims.

DETAILED DESCRIPTION

In the following detailed description, reference is made to the accompanying drawings. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to a hair styling device for styling (e.g., drying, straightening, curling) the hair of a user. The hair styling device is configured to style the hair of a user without the user holding onto or handling the device or their hair. The hair styling device fits over the head of the user and surrounds the hair of the user while in a styling position. One or more clips hold the device in place surrounding the hair. A cordless and rechargeable hair dryer can be removably attached to the device to supply heated air to the hair of the user. The hair styling device additionally includes various auxiliary attachments for use with longer hair and for interchangeable hair styles (e.g., straight, curly, wavy, etc.).

Figure 1:
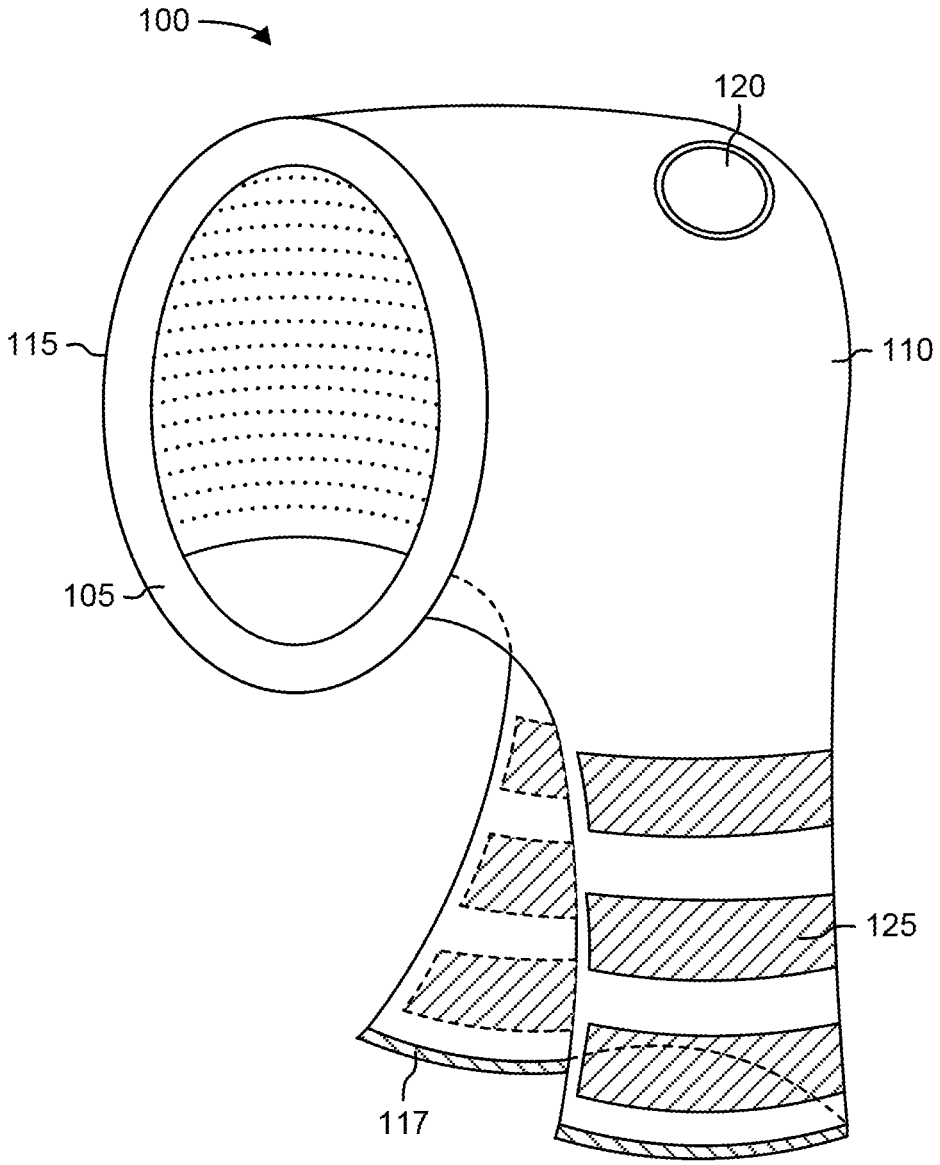
FIG. 1 is a perspective view of a hair styling device, according to an exemplary embodiment.

Referring to FIG. 1, a hair styling device, shown and described as device 100, is shown according to an exemplary embodiment. The device 100 is shown as including a headband 105 and a hair wrap 110. The headband 105 is configured to conform to a user's head and maintain the device 100 in a styling position. As such, in an exemplary embodiment, the headband 105 is made of an elastic or resiliently conformable material. In other embodiments, the headband 105 can be made of any material suitable to conform to the head of the user. In one embodiment, the headband 105 is circular in shape. In another embodiment, the headband 105 is oval in shape. In other embodiments, the headband 105 is any other shape suitable to fit the head of the user.

The hair wrap 110 is attached to the headband 105 along a portion of a perimeter 115 of the headband 105. In other embodiments, the hair wrap 110 is attached along the entire perimeter 115 of the headband 105. The hair wrap 110 is sewn to the perimeter 115 of the headband 105 for attachment. In other embodiments, the hair wrap 110 is attached to the headband 105 by any other attachment suitable. The hair wrap 110 is made of a heat-resistant and water absorbent cloth material. Accordingly, the hair wrap 110 is configured to absorb moisture and trap warm air on the hair of the user, while allowing warm air to vent from the hair wrap 110 of the device 100. In some embodiments, the hair wrap 110 includes an attachment 117 to removably attach various auxiliary attachments to the device 100.

Figure 2:
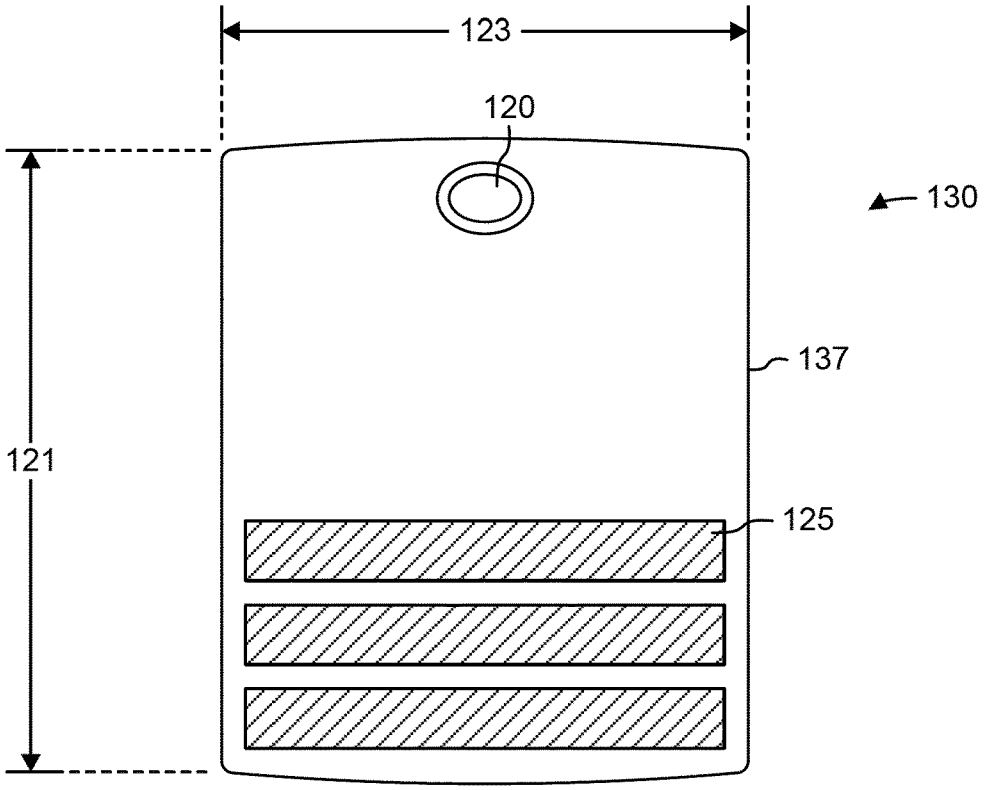
FIG. 2 is a rear view of an outside layer of the hair styling device of FIG. 1, according to an exemplary embodiment.
Figure 3:
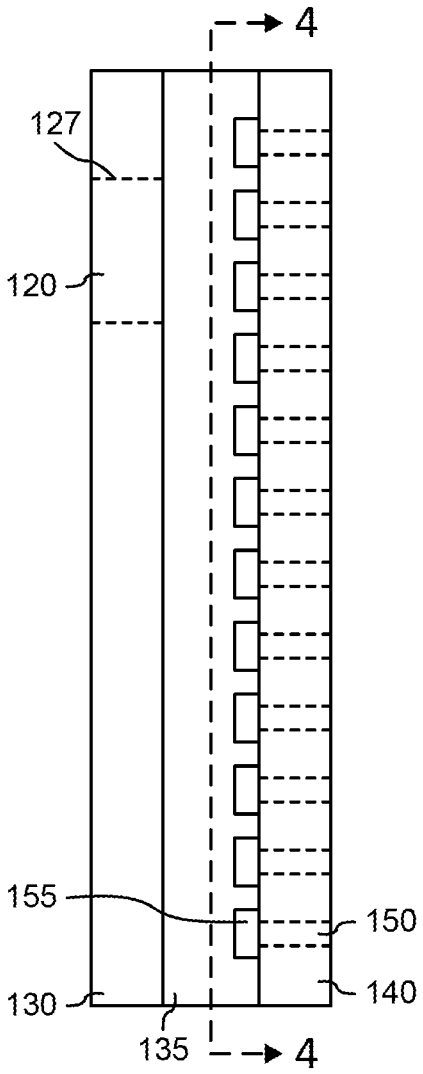
FIG. 3 is a side view of a hair cover portion of the hair styling device of FIG. 1, according to an exemplary embodiment.
Figure 4:
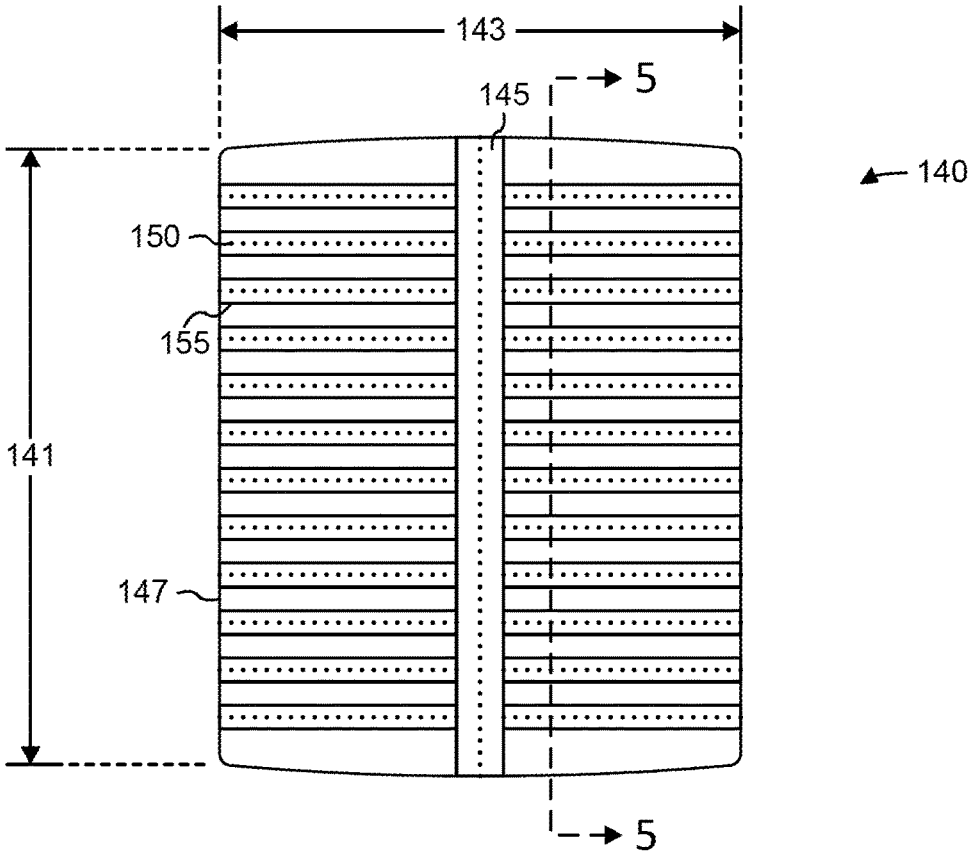
FIG. 4 is a rear view of an inside layer of the hair styling device of FIG. 1, according to an exemplary embodiment.
Figure 4A:
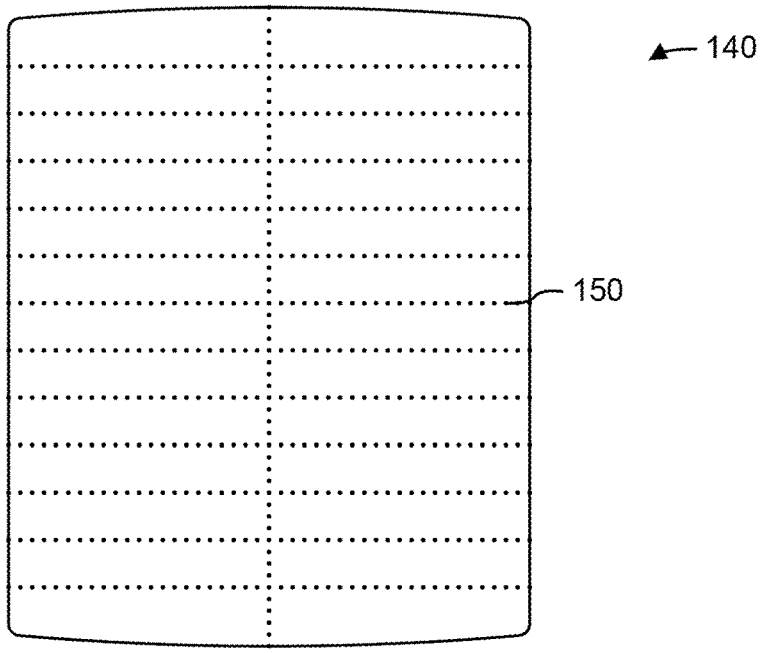
FIG. 4A is a front view of the inside layer of FIG. 4, according to an exemplary embodiment.
Figure 5:
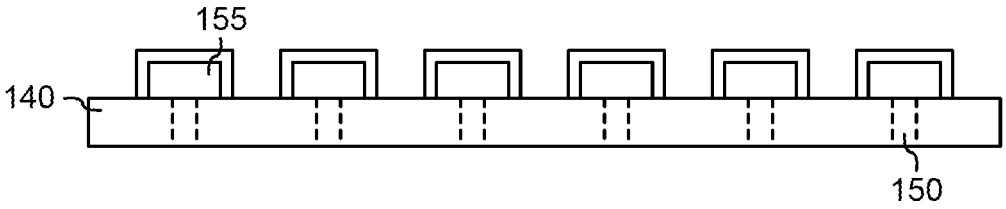
FIG. 5 is a section view of the inside layer of FIG. 4 taken along line 5-5, according to an exemplary embodiment.
Figure 6:
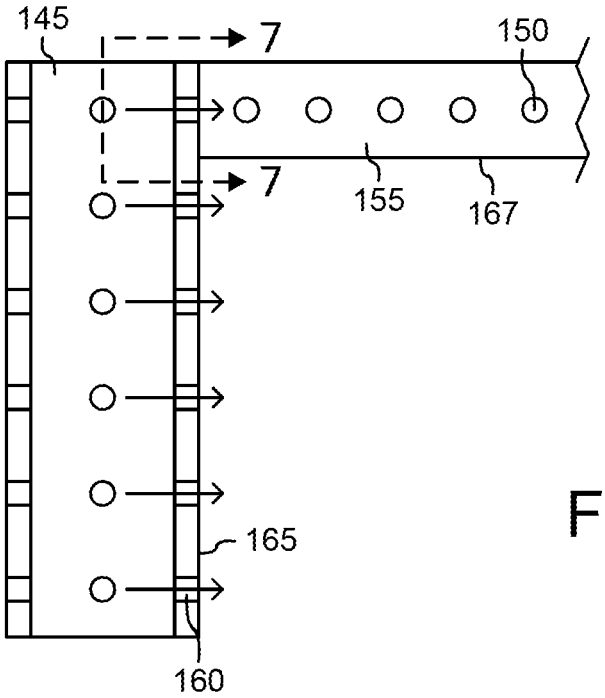
FIG. 6 is a rear view of a section of the inside layer of FIG. 4, according to an exemplary embodiment.

Referring to FIGS. 2-4, the hair wrap 110 includes an outside layer 130 and an inside layer 140. The outside layer 130 and the inside layer 140 can be substantially the same shape such that the two layers 130, 140 can be attached at respective perimeters 137, 147. In one embodiment, the outside layer 130 and the inside layer 140 are sewn together. In another embodiment, the outside layer 130 and the inside layer 140 are glued together. In other embodiments, the outside layer 130 and the inside layer 140 are attached through any permanent attachment method. The outside layer 130 and the inside layer 140 form an interior volume 135 (e.g., channel, space, pathway) as shown in FIG. 3. The interior volume 135 is configured to direct the flow of air through the hair wrap 110. In an exemplary embodiment, the inside layer 140 is made from a spongy scuba material. In other embodiments, the inside layer 140 is made from another flexible cloth-like material.

The outside layer 130 includes a hair dryer attachment 120 and one or more clips 125. The hair dryer attachment 120 is configured to removably attach a hair dryer 180 to the outside layer 130 of the hair cover portion 110. The hair dryer attachment 120 is additionally configured to direct the flow of air into the interior volume 135 of the hair wrap 110, creating a positive pressure to direct warm air flow within the interior volume 135 and through the inside layer 140 via an air distribution network. In one embodiment, the hair dryer attachment 120 is circular in shape. In other embodiments, the hair dryer attachment 120 can be of any shape to accept the hair dryer 180. The hair dryer attachment 120 includes a mating portion 127 (e.g., threads, locking tabs) configured to removably attach the hair dryer 180 to the outside layer 130. In some embodiments, the mating portion 127 can be a fastener with a hard-stop or detent feature (e.g., insert, then quarter-turn fastener to a hard-stop, etc.) with a tactile or audible indication (e.g., "click" or "snap") signaling that the hair dryer 180 is attached to the device 100. In this way, the user can easily know when the hair dryer 180 is attached to the device 100 without having to visually check for the attachment. In other embodiments, the mating portion 127 can be any other form of fastener to attach the hair dryer 180 to the device 100. The clips 125 (e.g., bistable spring bands, snap-clips, berets) are configured to surround the hair of the user with the hair wrap 110, including both the outside layer 130 and the inside layer 140. In an open position, the clips 125 are substantially flat in shape. In a closed position, the clips 125 are in a circular shape around the hair. In other embodiments, the clips 125 can close to form a flat (e.g., rectangular) shape around the hair. In some embodiments, the clips 125 can have varying stiffness. For example, the clips 125 nearer the top portion of the device 100 may be stiffer than the clips 125 nearer the bottom portion of the device 100. In an exemplary embodiment, the clips 125 are surrounded in a cloth-like material (e.g., felt, heat-resistant cloth) to provide comfortable wear of the device 100. In other embodiments, the clips 125 are not surrounded in a cloth-like material.

Figure 2A:
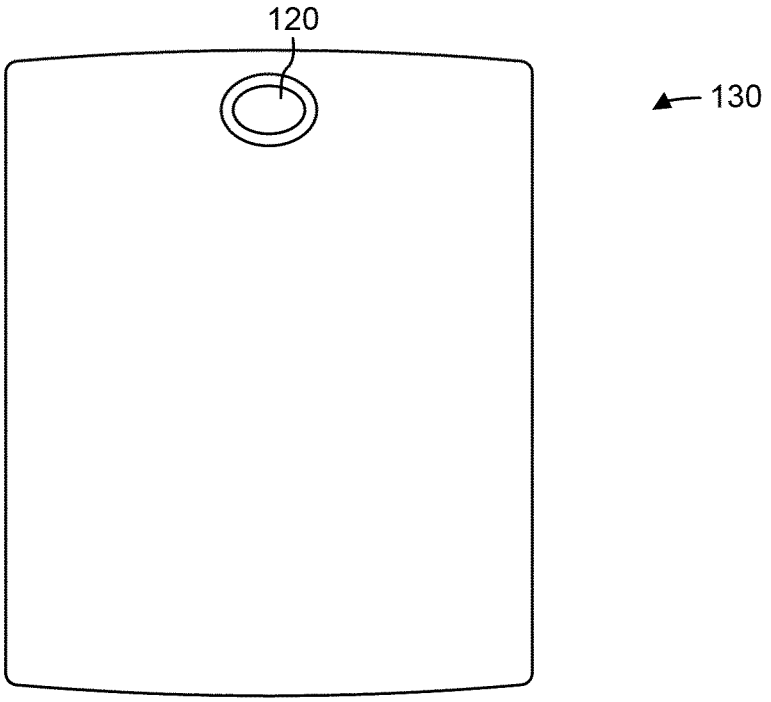
FIG. 2A is a front view of the outside layer of FIG. 2, according to an exemplary embodiment.
Figure 8:
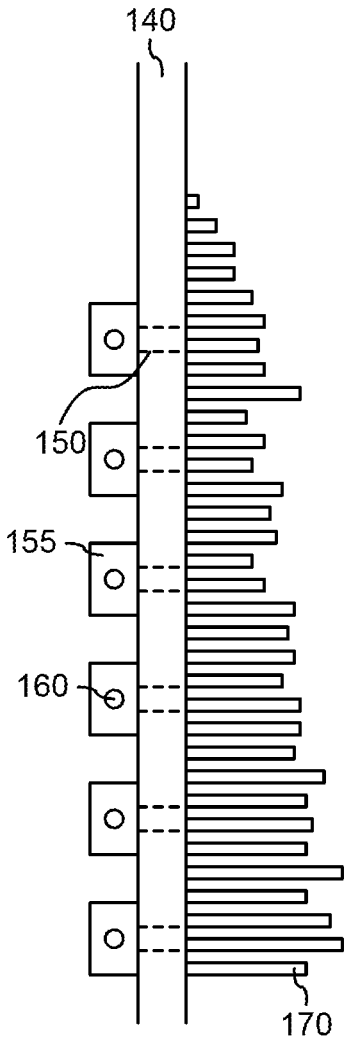
FIG. 8 is a more detailed view of the inside layer of FIG. 4 with added bristles, according to an exemplary embodiment.

In one contemplated embodiment, the device 100 includes a single layer (e.g., outside layer 130) to direct air flow to the hair of the user. The single layer includes a hair dryer attachment and one or more clips, similar to the embodiment shown in FIGS. 2-2A. Air flows through hair dryer attachment and onto the hair of the user. With no inside layer or air distribution network, air flows freely onto the hair. Furthermore, bristles (as shown in FIG. 8) may be included with the single layer.

Referring now to FIGS. 4-7, the inside layer 140 includes an air distribution network having a main air channel 145 and a plurality of side air channels 155, with a plurality of air vents 150 evenly distributed among the main air channel 145 and the plurality of side air channels 155. The main air channel 145 is configured to receive air flow from the hair dryer attachment 120.

Figure 7:
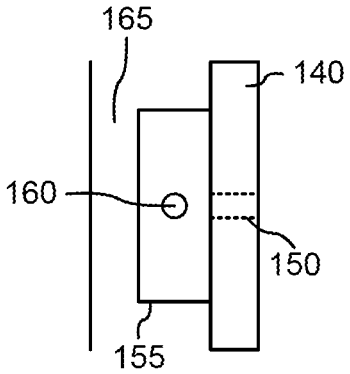
FIG. 7 is a section view of the inside layer of FIG. 6, according to an exemplary embodiment.

The main air channel 145 is configured to direct air flowing into the interior volume 135 from the hair dryer attachment 120 and out of the inside layer 140 onto the hair of the user. The main air channel 145 includes side walls 165 configured to direct the incoming air. The side walls 165 enclose the main air channel 145 on three sides, with the surface of the inside layer 140 enclosing the main air channel 145 on the fourth side. In other embodiments, a singular side wall 165 in a curved shape encloses the main air channel 145 against the inside layer 140. In other embodiments, the main air channel is not enclosed and instead, includes only two side walls 165. In another embodiment, the main air channel 145 is made from a conforming material such that the shape of the channel 145 is not solid and instead changes (e.g., collapses, inflates, etc.) with the air flow within the channel 145. The side walls 165 extend along at least part of a full length 141 of the inside layer 140. In some embodiments, the side walls 165 extend the full length 141 of the inside layer 140. As shown in FIG. 7, the side walls 165 of the main air channel 145 include air passages 160 configured to allow the flow of air from the main air channel 145 to the side air channels 155. The air passages 160 are shown to be circular in shape. In other embodiments, the air passages 160 can be any shape to allow the directed flow of air.

The side air channels 155 are configured to create a distributed air effect on the hair of the user. The side air channels 155 direct air flowing from the main air channel 145 toward the plurality of air vents 150. The side air channels 155 extend from the main air channel 145 and are substantially perpendicular to the main air channel 145. In other embodiments, the side air channels 155 extend from the main air channel 145 at varying angles. Each of the side air channels 155 includes side walls 167 configured to direct the incoming air. The side walls 167 enclose the side air channels 155 on three sides, with the surface of the inside layer 140 enclosing the side air channels 155 on the fourth side. In other embodiments, a singular side wall 167 in a curved shape encloses the side air channels 155 against the inside layer 140. In other embodiments, the side air channels 155 are not enclosed and instead, include only two side walls 167. The side walls 167 extend along at least part of a full width 143 of the inside layer 140. In some embodiments, the side walls 165 extend the full width 143 of the inside layer 140.

Figure 3A:
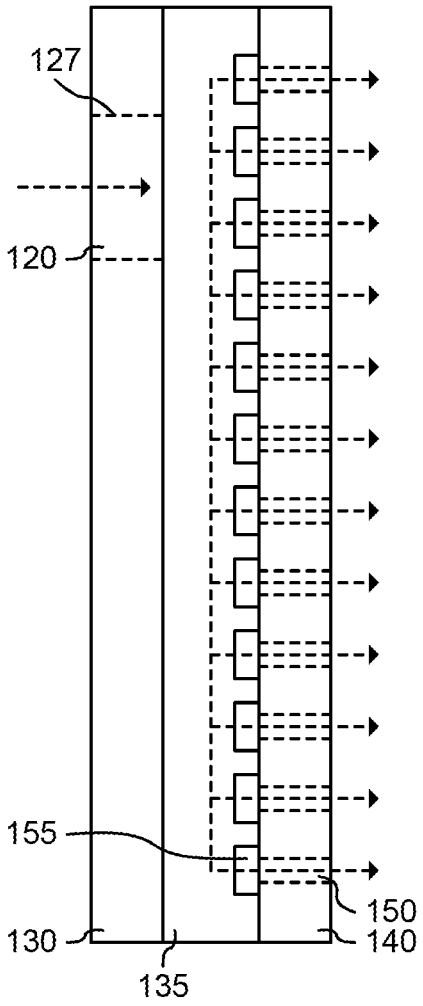
FIG. 3A is a side view of a hair cover portion of the hair styling device of FIG. 1 showing air flow distribution, according to an exemplary embodiment.

As shown in FIG. 3A, air flows into the device from the hair dryer 180 through the hair dryer attachment 120. The air enters the interior volume 135 and the main air channel 145. The air is distributed into the side air channels 155 via air passages 160. Then, the air is distributed onto the hair of the user through the inside layer 140 via air vents 150 positioned within the main air channel 145 and side air channels 155.

Figure 3B:
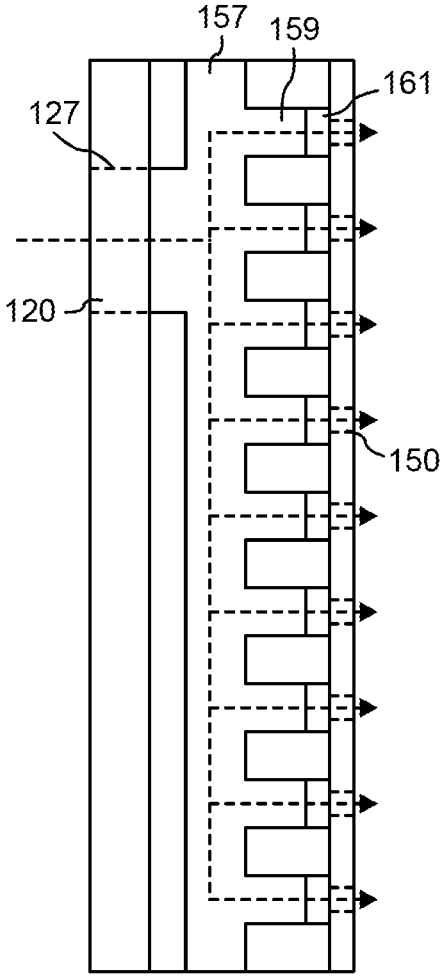
FIG. 3B is a side view of a hair cover portion of the hair styling device of FIG. 1, according to an exemplary embodiment.
Figure 3C:
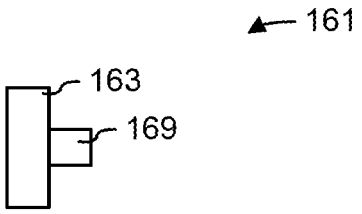
FIG. 3C is a side view of a snap member of the hair styling device of FIG. 1, according to an exemplary embodiment.

In another embodiment shown in FIG. 3B, the air distribution network includes a main air channel 157 including a tube-like structure connected to the hair dryer attachment 120 on one side and to side air channels 159 on another side. The main air channel 157 and side air channels 159 direct air flow through the device 100. Snap members 161 are included and attached at (e.g., formed on, coupled to) the side air channels 159 between the side air channels 159 and the inside layer 140 of the device 100. As shown in FIG. 3C, the snap members 161 can be button-shaped, with a top portion 163 and a protrusion 169 extending outward from the top portion 163. In other embodiments, the snap members 161 are otherwise shaped. The protrusion 169 is hollow to allow air to flow through the member 161. The snap members 161 attach (e.g., snap, click) to the inside layer 140 at the air vents 150 to allow air to flow onto the hair of the user. The protrusion 169 slidably engages with the air vent 150. In some embodiments and as described below with regard to FIG. 3D, the protrusion 169 can slidably engage with an overlapping portion 151 formed within the air vent 150. In some embodiments, the snap members 161 may be removably attached to the air vents 150 similar to a button-snap such that an audible indication (e.g., "snap" or "click") is present when attached.

In some embodiments, the side air channels 159 may be free-floating within the interior volume 135 of the device. This arrangement may allow for flexing and twisting of the device 100 during use allowing for more comfort to the user. In an exemplary embodiment, the main air channel 157, side air channels 159, and snap members 161 are made from a flexible, heat-resistant plastic. In other embodiments, the main air channel 157, side air channels 159, and snap members 161 can be made of other suitable materials.

Figure 3D:
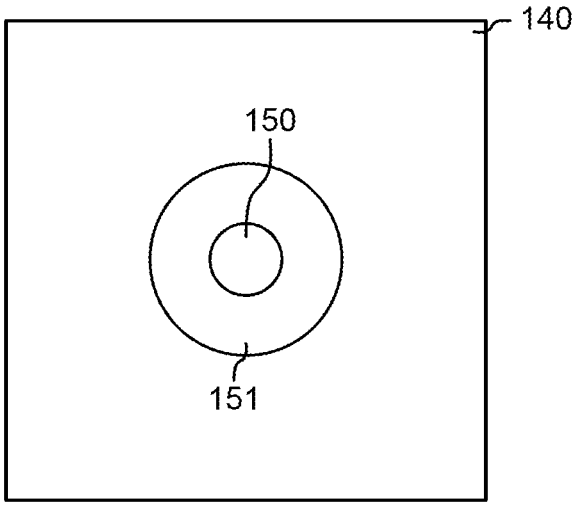
FIG. 3D is a front view of an air vent of the hair styling device of FIG. 1, according to an exemplary embodiment.

Referring to FIG. 3D, an air vent 150 is shown. In an exemplary embodiment, the air vent 150 is surrounded by an overlapping portion 151 (e.g., flange, lip). In another embodiment, the air vent 150 can be formed without an overlapping portion 151. The overlapping portion 151 is configured to structurally support the air vent 150. The overlapping portion 151 is additionally configured to mate with the snap member 161 to attach the side air channels 159 to the air vents 150. The overlapping portion 151 is a separate piece attached to the inside layer 140. In other embodiments, the overlapping portion 151 is formed with the snap member 161. The overlapping portion 151 extends into the air vent 150 such that it is contacting the side wall of the air vent 150. The overlapping portion 151 can receive and hold the protrusion 169 of the snap member 161 when inserted into the air vent 150. In an exemplary embodiment, the overlapping portion 151 is made from a heat-resistant plastic. In another embodiment, the overlapping portion 151 may be part of the fabric of the inside layer 140 of the device 100. In other embodiments, the overlapping portion 151 can be made from other suitable materials.

In another embodiment, there is no air distribution network. In this embodiment, the outside layer 130 is air-impermeable and the inside layer 140 is substantially air-permeable such that air flows into the interior volume 135 from the hair dryer attachment 120 and flows through the inside layer 140 onto the hair of the user. The inside layer 140 can have variable air-permeability such that near the hair dryer attachment 120 the inside layer 140 is relatively less air-permeable than further away from the hair dryer attachment 120 to provide a progressive air flow distribution effect. The outside layer 130 can be made from (or otherwise include) a plasticized material such that air does not escape through the outside layer 130. The inside layer 140 can be made from any substantially air-permeable material such as, a foam material, terry cloth, or other material that allows air to freely flow from the hair dryer attachment 120 and through the inside layer 140 onto the hair of the user.

Figure 8A:
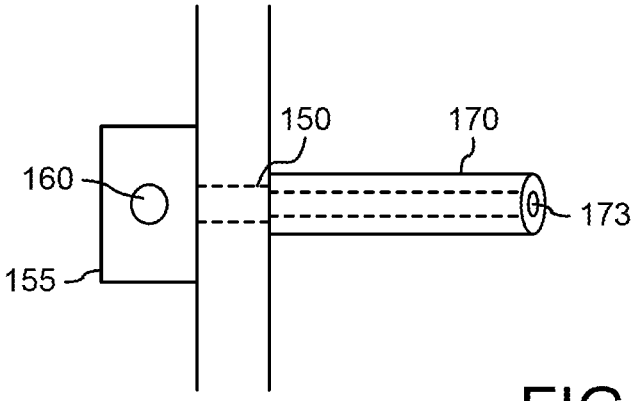
FIG. 8A is a more detailed view of the inside layer of FIG. 8, according to an exemplary embodiment.

Referring now to FIG. 8, in one embodiment, the air distribution network also includes a plurality of bristles 170 extending from the inside layer 140. The bristles 170 are configured to brush the hair of the user back and into position within the device 100 when first put in place on the user. The bristles 170 may additionally be configured to supply heated air to portions of the hair at a further depth than the first layer of hair. The bristles 170 are shown to be of varying lengths. In other embodiments, the bristles 170 are uniform in length. The bristles 170 extend along a bottom portion of the inside layer 140. In some embodiments, the bristles 170 extend across the width 143 and up to one-third the length 141 of the inner layer 140. In one embodiment, the bristles 170 are solid and cylindrical in shape. In another embodiment as shown in FIG. 8A, the bristles 170 are hollow and cylindrical in shape such that the bristles 170 include an inner diameter 173. In some embodiments, the inner diameter 173 of the hollow bristles 170 can be in fluid communication with plurality of air vents 150 such that heated air can flow through bristles 170 and into the deeper layers of the hair, in order to provide a more uniform and less time-consuming hair drying experience.

The hair dryer 180 is configured to force heated air into the interior volume 135 between the outside layer 130 and the inside layer 140. In some embodiments, the hair dryer 180 forces ambient temperature air into the interior volume 135. In some embodiments, the hair dryer 180 forces air into the main air channel 145 to be distributed to the side air channels 155 via the air passages 160.

Figure 9:
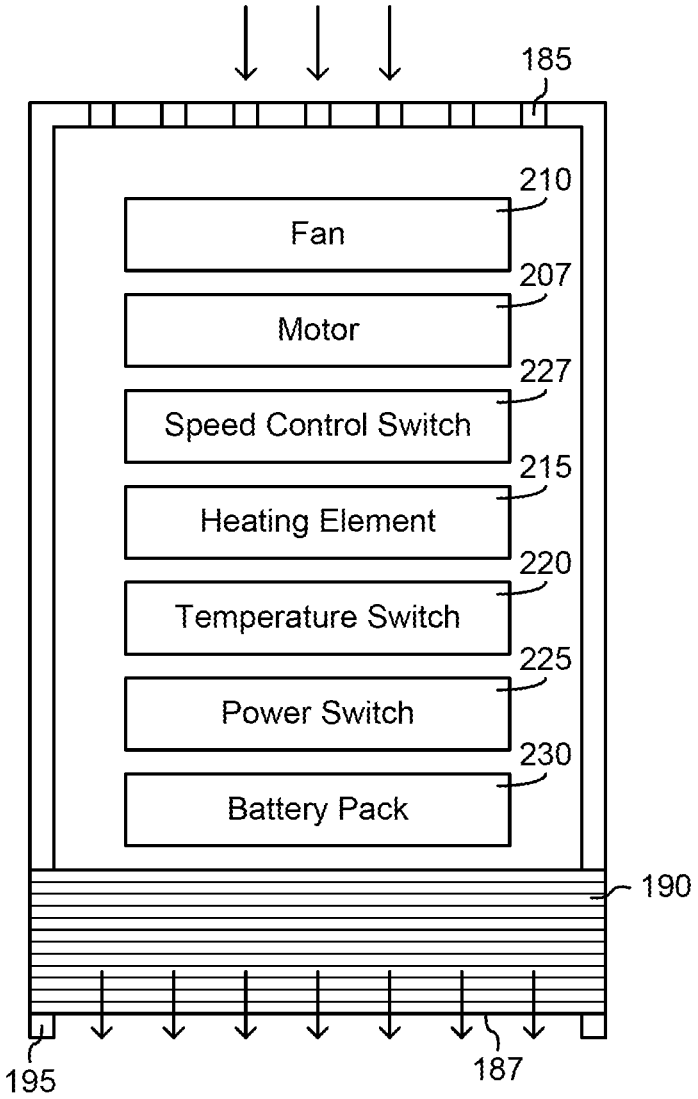
FIG. 9 is a front schematic view of a cordless hair dryer, according to an exemplary embodiment.
Figure 10:
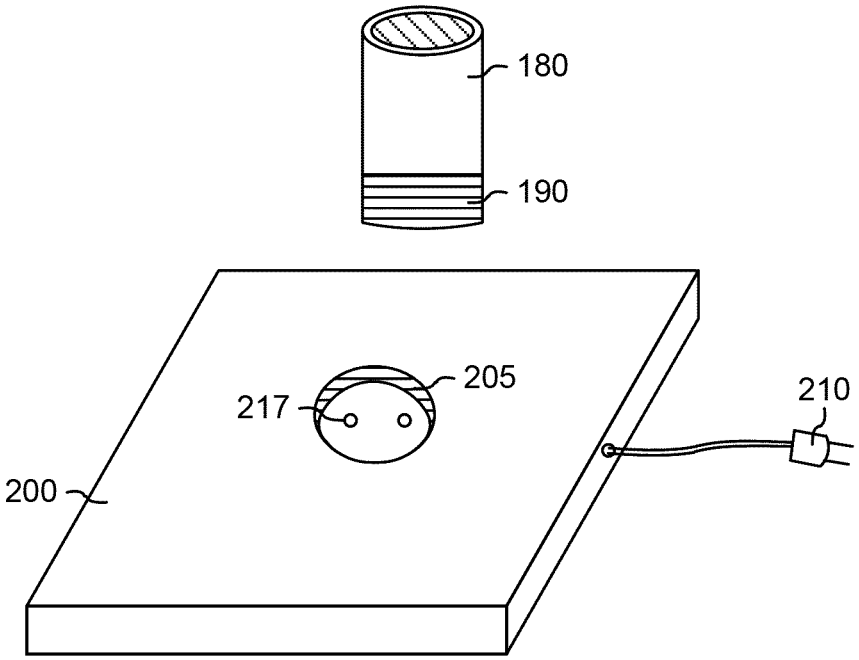
FIG. 10 is a perspective view of the cordless hair dryer of FIG. 9 with a charging station, according to an exemplary embodiment.

Referring to FIGS. 9 and 10, the hair dryer 180 includes an air intake 185 and an air exhaust 187. Air travels into the air intake 185, past other components of the hair dryer 180 and out of the air exhaust 187. The hair dryer 180 additionally includes at least a motor 207, a fan 210, a heating element 215, a battery pack 230, a power switch 225, a speed control switch 227, and a temperature switch 220. The fan 210 pulls in outside air through the air intake 185 and into the hair dryer 180. The motor 207 is configured to actuate the fan 210. The motor 207 is electrically coupled to the battery pack 230 to be powered by the battery pack 230. When activated in response to a user input (e.g., power switch 225), the motor 207 rotates the fan 210. In some embodiments, the speed of the motor 207 is controlled by the user via the speed control switch 227. The heating element 215 is configured to heat the air passing through the hair dryer 180. The heating element 215 is controlled by the temperature switch 220, which is in turn controlled by the user.

The battery pack 230 is rechargeable via a recharge station 200 as shown in FIG. 10. The recharge station 200 includes a docking port 205 with electrical mating elements 217 configured to mate with the electrical contacts 195 on the hair dryer 180 to recharge the battery pack 230 of the hair dryer 180. The recharge station 200 further includes a power cord 210 configured to be connected to a source of electrical power (e.g., an electrical outlet connected to a grid or generator). The type of plug on the cord 210 varies depending on the market in which the recharge station 200 is used (e.g., the United States uses a different plug configuration than Europe, the United Kingdom uses a different plug configuration than other countries in Europe, etc.). The power cord 210 is electrically connected to a transformer which converts the input electrical power to an electrical power form appropriate for charging the battery pack 230.

Figure 11:
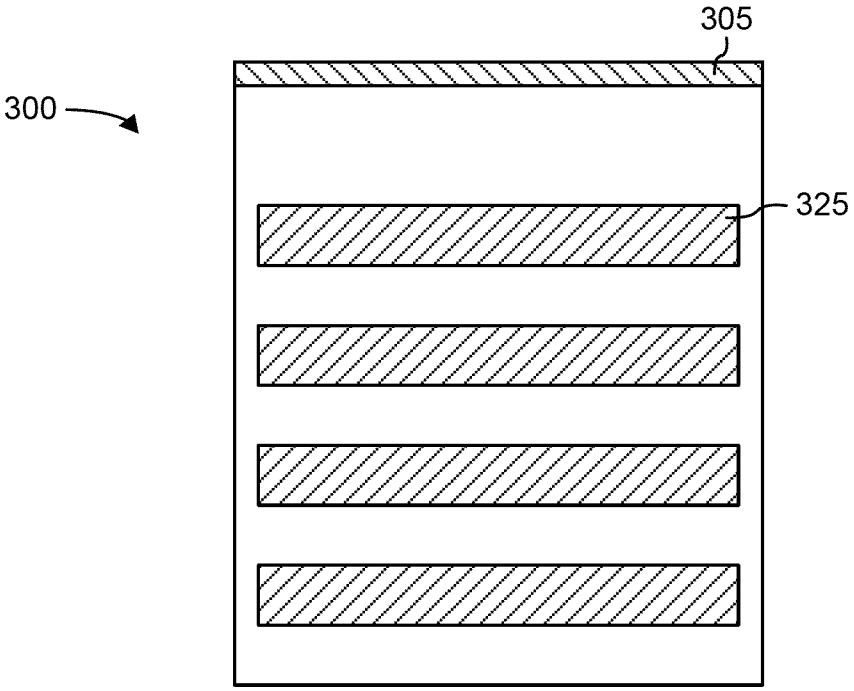
FIG. 11 is a front view of an attachment hair cover, according to an exemplary embodiment.
Figure 12:
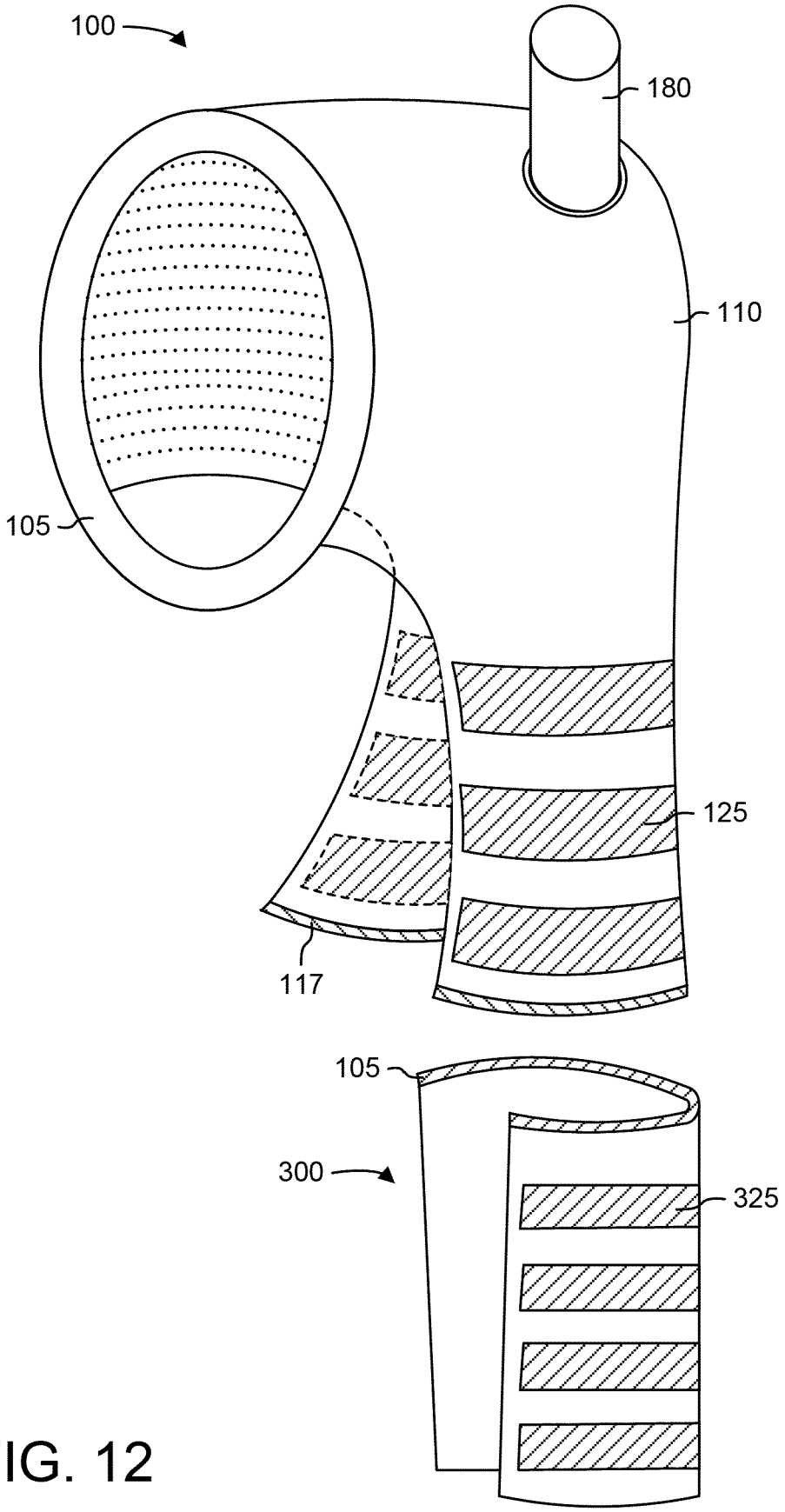
FIG. 12 is a perspective view of the hair styling device of FIG. 1 including the cordless hair dryer of FIG. 9 and the attachment hair cover of FIG. 11, according to an exemplary embodiment.

The hair styling device 100 includes various auxiliary attachments for use with the device 100. As shown in FIGS. 11 and 12, an extension 300 can be included with the device 100 to be used with users having relatively longer hair that may not fit within the device 100 without the extension 300. The extension 300 includes similar components to the hair wrap 110 described above, including an inside layer, an outside layer, a main air channel, side air channels, a plurality of air vents, and one or more clips 325. The extension further includes an extension attachment 305. The extension attachment 305 is configured to removably attach the extension 300 to the hair wrap 110. The extension attachment 305 can be a fastener with a hard-stop or detent feature (e.g., insert, then quarter-turn fastener to a hard-stop, etc.) with a tactile or audible indication (e.g., "click" or "snap") signaling that the extension 300 is attached to the device 100. In this way, the user can easily know when the extension 300 is attached to the device 100. In another embodiment, the extension attachment 305 can be a hook-and-loop type fastener (e.g., Velcro® fastener). In other embodiments, the extension attachment 305 can be any other form of fastener to attach the extension 300 to the device 100. To allow air to freely flow from the hair wrap 110 to the extension 300, the extension attachment 305 can attach the inside layer and the outside layer of the extension 300 to the inside layer 140 and the outside layer 130 of the hair wrap 110, respectively. In this case, the bottom edge of the attachment between the inside layer 140 and the outside layer 130 of the hair wrap 110 can be separable near the attachment 117 to allow for air flow between the layers 140, 130.

Figure 13:
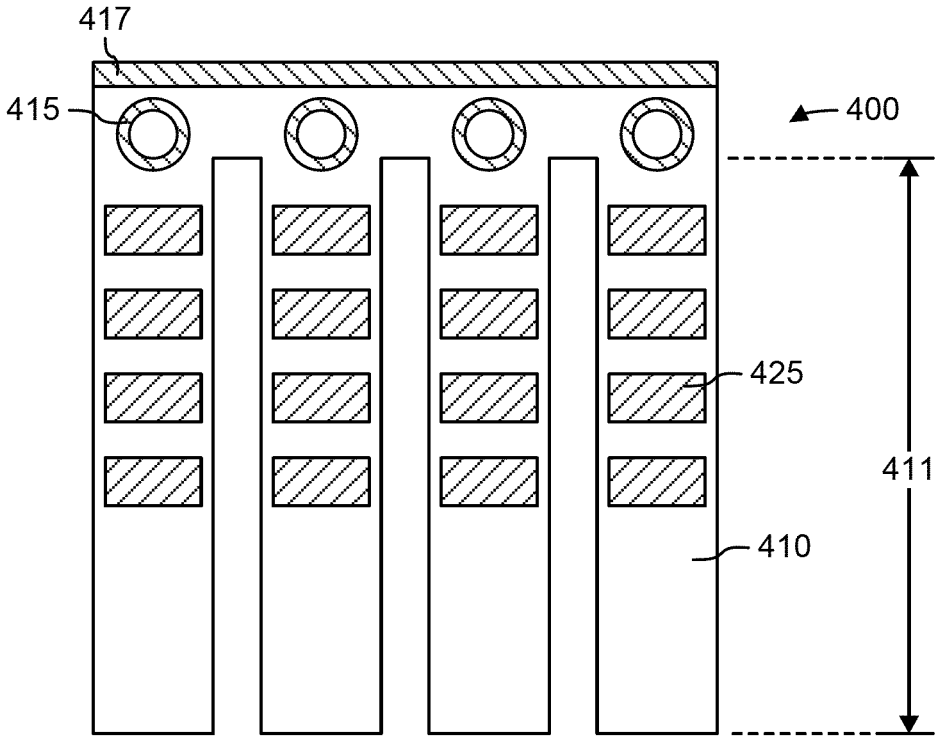
FIG. 13 is a front view of a curling attachment hair cover, according to an exemplary embodiment.

As shown in FIG. 13, a curling attachment 400 can be included. The curling attachment 400 can be removably attached to the hair wrap 110 similar to the extension 300 as described above. The curling attachment 400 includes multiple wrap sections 410. Each wrap section 410 has similar components to those of the hair wrap 110 described above. Accordingly, each wrap section 410 includes an inside layer, an outside layer, a main air channel, side air channels, a plurality of air vents, and one or more clips 425. The clips 425 (e.g., bistable spring bands, snap-clips, berets) are configured to surround the hair of the user with the wrap sections 410. In an open position, the clips 425 are substantially flat in shape. In a closed position, the clips 425 are in a circular shape around the hair. In other embodiments, the clips 425 can close to form a flat (e.g., rectangular) shape around the hair. In some embodiments, the clips 425 can have varying stiffness. The clips 425 on the curling attachment 400 can be relatively smaller and lighter than the clips 125 included on the hair wrap 110. Thus, the clips 425 can be more flexible on the curling attachment 400 than on the hair wrap 110. The clips 425 are shown to run the full length 411 of the wrap sections 410 and are equally spaced apart from each other.

Figure 14:
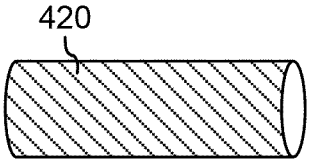
FIG. 14 is a front view of a roller, according to an exemplary embodiment.
Figure 15:
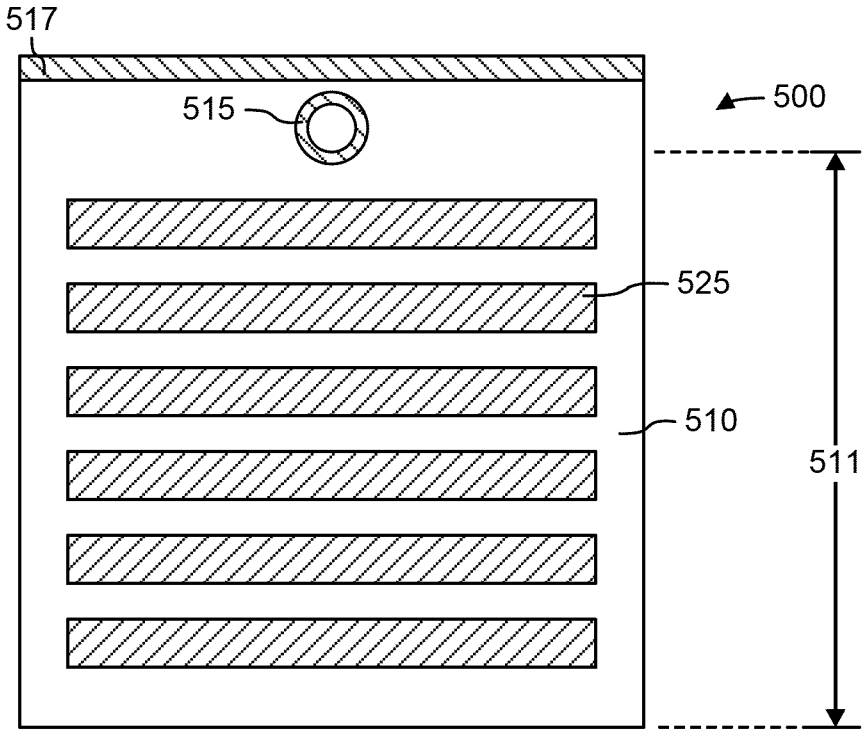
FIG. 15 is a front view of a curling attachment hair cover, according to an exemplary embodiment.

As shown in FIG. 13, the curling attachment 400 includes multiple elastic cords 415 each configured to hold a rolled-up wrap section 410. The curling attachment 400 further includes multiple rollers 420, shown in FIG. 14. To use the curling attachment 400, a user first divides their hair into sections, and then inserts each section into a separate wrap section 410. After the hair is inserted, the user closes the clips 425 such that each section of hair is surrounded by a wrap section 410. Next, the user starts from the bottom of each wrap section 410 and holding the roller 420 against the wrap section 410, rolls the section 410 around the roller 420 either in an under or over direction. The user continues to roll each section until at the top of the wrap section 410. The user then uses each elastic cord 415 to hold respective wrap sections 410 in a secured position. Due to the flexible nature of the curling attachment 400, the user is not limited to rolling the wrap sections 410. The user can also create other hairstyles by securing the wrap sections 410 in different ways. For example, after the user has secured their hair within each section 410, the user can braid or twist the sections 410 in different ways to create varying hairstyles. Referring to FIG. 15, another embodiment of the curling attachment 500 is shown. The curling attachment 500 shown in FIG. 15 includes a single wrap section 510 and a single elastic cord 515. In this embodiment, the curling attachment 500 can also be used with the rollers 420.

Figure 16:
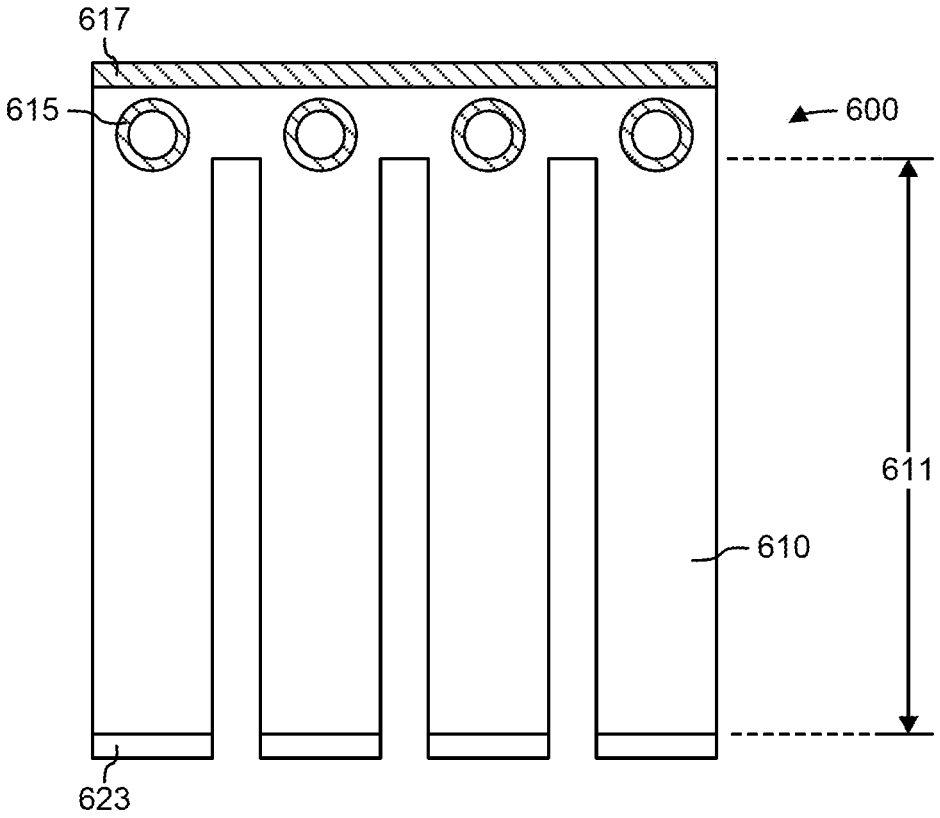
FIG. 16 is a front view of a waving attachment hair cover, according to an exemplary embodiment.

As shown in FIG. 16, a waving attachment 600 can be included. The waving attachment 600 can be removably attached to the hair wrap 110 similar to the extension 300 as described above (e.g., by attachment feature 617). The waving attachment 600 includes multiple wrap sections 610. Each wrap section 610 has similar components to those of the hair wrap 110 described above. Accordingly, each wrap section 410 includes an inside layer, an outside layer, a main air channel, side air channels, a plurality of air vents, and one or more clips. In one embodiment, the waving attachment 600 can include multiple elastic cords 615 each configured to hold a rolled-up wrap section 610. In another embodiment, the waving attachment 600 does not include the elastic cords 615. In some embodiments, the clips can have varying stiffness. The clips on the waving attachment 600 can be relatively smaller and lighter than the clips 125 included on the hair wrap 110. Thus, the clips can be more flexible on the waving attachment 600 than on the hair wrap 110.

Each of the wrap sections 610 includes a tubular section 623 at a distal end of each of the wrap sections 610 with respect to the attachment feature 617. The tubular section 623 is configured to receive the cylindrical member 625 shown in FIG. 17 and described further herein. The attachment feature 617 is configured to attach the waving attachment 600 to the device 100 at the attachment 117. In other embodiments, the waving attachment 600 can be otherwise attached to the device 100.

Figure 17:
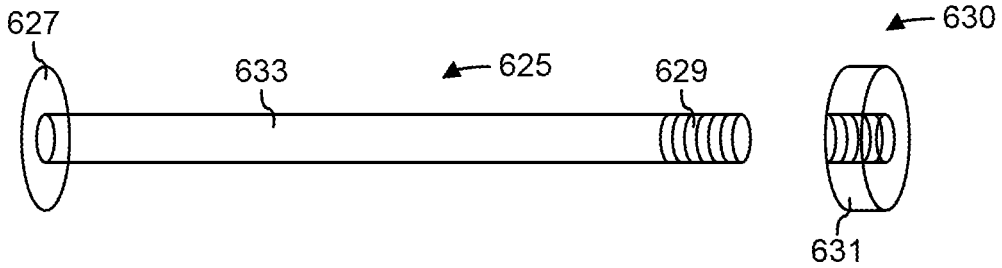
FIG. 17 is a front view of a cylindrical member and cap, according to an exemplary embodiment.

As shown in FIG. 17, the waving attachment 600 further includes a cylindrical member 625 (e.g., stick, rod). The cylindrical member 625 is configured to fit within the tubular section 623 of each wrap section 610 and secure the sections in place for styling. As such, the cylindrical member 625 is at least as long as the length of all the wrap sections 610 combined. The cylindrical member 625 includes a threaded end 629, an elongated body 633, and a capped end 627. A cap 630 with a cap threaded portion 631 is included and configured to mate with the threaded end 629 of the cylindrical member 625 to secure the wrap sections 610 in place for styling. When held in place on the cylindrical member 625, movement of the wrap sections 610 is restricted by the cap 630 and the capped end 627 of the cylindrical member 625 such that the wrap sections 610 will remain on the cylindrical member 625.

Figure 18:
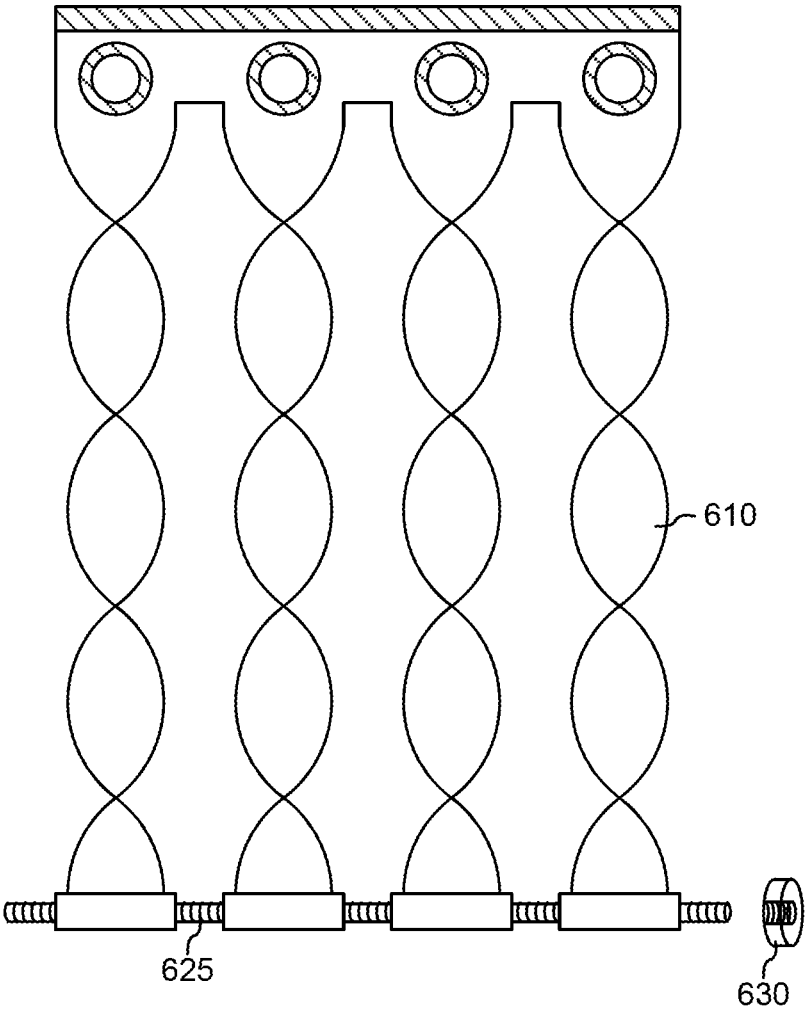
FIG. 18 is a front view of a waving attachment hair cover of FIG. 16 with the cylindrical member of FIG. 17 inserted, according to an exemplary embodiment.

To use the waving attachment 600, a user first divides their hair into the number of wrap sections 610 provided with the waving attachment 600. In this example, the user divides their hair into four equal parts and then, inserts the hair into respective wrap sections 610. The user then closes the wrap sections 610 as described above using one or more clips. In an embodiment without clips, the user may close the wrap sections 610 using any other fastening mechanism. Next, the user twists each wrap section 610 as shown in FIG. 18. As each section is wrapped, the user can insert the cylindrical member 625 into the tubular section 623 of that particular wrap section 610. The user continues to wrap each wrap section 610 and insert that wrap section 610 onto the cylindrical member 625. Once the user has inserted each wrap section 610 onto the cylindrical member 625, the user then fastens (e.g., screws, clips, snaps) the cap 630 to the cylindrical member 625. The user can also create other hairstyles by securing the wrap sections 610 in different ways. For example, after the user has secured their hair within each section 610, the user can braid or twist the sections 610 in different ways prior to inserting the cylindrical member 625 to create varying hairstyles.

In other contemplated embodiments, the waving attachment 600 includes one or more inwardly protruding structures (e.g., ribs, vanes, ridges) configured to conform hair into a wave pattern established by the device. The inwardly protruding structures can be of any shape so as to style the hair in that shape. In some embodiments, the inwardly protruding structures can include air vents (e.g., passages, holes, vanes) configured to allow air to flow through the structures and onto the hair. In an exemplary embodiment, the inwardly protruding structures are made of a plastic material. In other embodiments, the inwardly protruding structures are made of any other suitable material.

The device 100 can be used with or without the hair dryer 180. A user can use the device 100 overnight while sleeping and without the hair dryer 180 attached. Because of the direct application, the air supplied to the hair wrap 110 does not need to be of a high temperature to accomplish a hair style. For example, the temperature needed to achieve desired results can range from ambient temperature to approximately 125° Fahrenheit (F) (51.7° Celsius (C)). Thus, damage to hair resulting from excessive heat is less likely to occur using the device 100 than with a conventional hair dryer, straightener, curler, or other styling device. Furthermore, the device 100 allows a user to complete other tasks while styling their hair with the device 100. For example, a user can tend to her children while wearing the device 100 instead of spending that time styling her hair or forfeiting the option to style her hair due to other necessary tasks. Accordingly, the hands-free nature of the device 100 allows users to free up time that would otherwise be spent styling their hair.

It is important to note that the construction and arrangement of the hair styling device as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. While the detailed drawings, specific examples, and particular formulations given describe certain exemplary embodiments, they serve the purpose as illustration only. The invention is not limited to the specific forms shown. The configuration of hair styling device may differ depending on chosen performance characteristics and physical characteristics of the components of the hair styling device. For example, the implement may take a variety of configurations and perform different functions depending on the needs of the user. Furthermore, other substitutions, modifications, changes, and omissions may be made in the design, operating conditions, and arrangement of the exemplary embodiments without departing from the scope of the invention as expressed in the appended claims. Elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A portable and wearable hair styling device, comprising:

a headband configured to conform to a head of a user; and a hair wrap attached to the headband along an upper portion of the hair wrap, wherein the hair wrap comprises:

a flexible inside layer trapping warm air on hair of the user and allowing warm air to vent from the hair wrap;

an air distribution network; and a flexible outside layer having substantially a same shape as the flexible inside layer and attached to the flexible inside layer along respective perimeters of the flexible outside layer and the flexible inside layer, thereby creating an interior volume between the flexible inside layer and the flexible outside layer, wherein the flexible outside layer comprises:

a hair dryer attachment; and a clip secured to a lower portion of the hair wrap opposite the upper portion and configured to transition between an open position in which the clip forms an open shape and a closed position in which the clip forms a closed shape surrounding the hair of the user with the hair of the user extending through the closed shape when the clip is in the closed position, wherein the clip holds the lower portion of the hair wrap including both the flexible inside layer and the flexible outside layer in place surrounding the hair of the user when the clip is in the closed position, and the air distribution network extends past the clip to direct air flow through the hair wrap and to both a first portion of the hair of the user located on a first side of the clip before extending past the clip, and a second portion of the hair of the user located on a second side of the clip after extending past the clip.

2. The hair styling device of claim 1, wherein the air distribution network comprises a plurality of air vents and a plurality of passageways in air flow communication with the hair dryer attachment and the flexible inside layer.

3. The hair styling device of claim 2, wherein the plurality of passageways comprises:

a main air channel; and a plurality of side air channels, wherein the plurality of side air channels are in fluid communication with the main air channel and extend from the main air channel.

4. The hair styling device of claim 3, wherein the main air channel comprises:

a first side wall and a second side wall attached to the flexible inside layer, wherein the first side wall and the second side wall form the main air channel;

wherein each of the first side wall and the second side wall comprises air passages connecting the main air channel with the plurality of side air channels.

5. The hair styling device of claim 4, wherein the plurality of side air channels are in fluid communication with at least a first portion of the plurality of air vents to allow air to flow onto the hair of the user.

6. The hair styling device of claim 5, wherein the main air channel is in fluid communication with at least a second portion of the plurality of air vents to allow air to flow onto the hair of the user.

7. The hair styling device of claim 6, wherein the main air channel is configured to direct air flow into the plurality of side air channels; and wherein the plurality of side air channels are configured to direct air flow through the plurality of air vents and onto the hair of the user.

8. A hair styling system comprising the hair styling device of claim 1 and further comprising:

a hair dryer configured to removably attach to the hair dryer attachment on the flexible outside layer and allow air to flow into the interior volume;

wherein the hair dryer heats incoming air and provides warmed air to the interior volume.

9. The hair styling system of claim 8, wherein the hair dryer is rechargeable and cordless.

10. The hair styling system of claim 9, further comprising a recharge station comprising:

a recharge base including a hair dryer receptacle configured to receive the hair dryer; and an electrical cord configured to be plugged into an electrical outlet.

11. The hair styling device of claim 1, wherein the air distribution network comprises a plurality of air vents disposed within the flexible inside layer.

12. The hair styling device of claim 1, wherein the flexible inside layer and the flexible outside layer are made from a heat-resistant and water absorbent material.

13. A hair styling system comprising the hair styling device of claim 1 and further comprising:

an extension attachment removably attached to the hair wrap, wherein the extension attachment is configured to straighten the hair of the user.

14. The hair styling device of claim 1, wherein the flexible outside layer is not air-permeable and the flexible inside layer is air-permeable.

15. The hair styling device of claim 1, wherein the interior volume is bounded by the flexible inside layer and the flexible outside layer.

16. The hair styling device of claim 1, wherein the clip is a first clip, the hair styling device further comprising one or more second clips spaced along the lower portion of the hair wrap and substantially parallel with the first clip.

17. The hair styling device of claim 1, wherein the lower portion of the hair wrap forms a substantially linear channel when the clip is in the closed position to hold the hair of the user in a straightening position within the substantially linear channel.

18. The hair styling device of claim 1, wherein the air distribution network is configured to direct the air flow through the closed shape formed by the clip when the clip is in the closed position.

19. The hair styling system of claim 13, wherein the extension attachment surrounds the second portion of the hair of the user located on the second side of the clip when the extension attachment is attached to the hair wrap and the hair of the user extends through the closed shape formed by the clip.

20. A portable and wearable hair styling system comprising:

a headband configured to conform to a head of a user;

a hair wrap attached to the headband, wherein the hair wrap comprises:

a flexible inside layer trapping warm air on hair of the user and allowing warm air to vent from the hair wrap;

an air distribution network;

a flexible outside layer attached to the flexible inside layer creating an interior volume between the flexible inside layer and the flexible outside layer; and a clip configured to close a lower portion of the hair wrap including both the flexible inside layer and the flexible outside layer to surround the hair of the user to direct air flow through the hair wrap and to the hair of the user; and an extension attachment removably attached to the hair wrap to surround a portion of the hair of the user that extends beyond the hair wrap, the extension attachment comprising a fastener attaching the extension attachment to at least one of the flexible inside layer, the air distribution network, or the flexible outside layer to direct the air flow from the hair wrap to the portion of the hair of the user that extends beyond the hair wrap to dry the portion of the hair of the user that extends beyond the hair wrap.

* * * * *